US011421703B2

(12) United States Patent
Rarick

(10) Patent No.: US 11,421,703 B2
(45) Date of Patent: Aug. 23, 2022

(54) IMPELLER FOR A LIQUID PUMP

(71) Applicant: Boyesen, Inc., Lenhartsville, PA (US)

(72) Inventor: Gregory S. Rarick, Kutztown, PA (US)

(73) Assignee: Boyesen, Inc., Lenhartsville, PA (US)

( * ) Notice: Subject to any disclaimer, the term of this patent is extended or adjusted under 35 U.S.C. 154(b) by 0 days.

(21) Appl. No.: 17/012,130

(22) Filed: Sep. 4, 2020

(65) Prior Publication Data

US 2021/0071680 A1 Mar. 11, 2021

Related U.S. Application Data

(60) Provisional application No. 62/896,185, filed on Sep. 5, 2019.

(51) Int. Cl.

| | |
|---|---|
| ***F04D 29/24*** | (2006.01) |
| ***F04D 29/22*** | (2006.01) |
| *F04D 29/42* | (2006.01) |
| *F04D 29/30* | (2006.01) |

(52) U.S. Cl.

CPC ..... *F04D 29/242* (2013.01); *F04D 29/2255* (2013.01); *F04D 29/30* (2013.01); *F04D 29/426* (2013.01)

(58) Field of Classification Search

CPC .... F04D 29/242; F04D 29/2255; F04D 29/30; F04D 29/245; F05D 2240/303

See application file for complete search history.

(56) References Cited

U.S. PATENT DOCUMENTS 4,594,052 A * 6/1986 Niskanen ..... F04D 7/045 415/121.1

6,398,498 B1 * 6/2002 Boyesen ..... F04D 29/2255 416/188

* cited by examiner

*Primary Examiner* — Sabbir Hasan

(74) *Attorney, Agent, or Firm* — Howson & Howson LLP

(57) ABSTRACT

A centrifugal pump impeller is providing that has vanes of a configuration that enhances pumping efficiency. The impeller has a base with a connector boss located at a center of rotation and a plurality of vanes extending from the base in spaced relation about the boss. Each vane having a leading end edge adjacent the boss and a trailing end edge adjacent an outer periphery of the base. Each of the trailing end edges being disposed parallel to an axis of rotation of the base, and each of the leading end edges being inclined forwardly at an angle relative to an operative rotational direction of the impeller and being spaced from the boss. For each vane, the leading end edge thereof is disposed at an acute angle relative to the trailing end edge thereof.

10 Claims, 5 Drawing Sheets

IMPELLER FOR A LIQUID PUMP

CROSS REFERENCE TO RELATED APPLICATIONS

This application claims the benefit under 35 USC § 119(e) of U.S. Provisional Patent Application No. 62/896,185, filed Sep. 5, 2019.

BACKGROUND

The present invention relates to an impeller design for liquid pumps, and more particularly, to an impeller for centrifugal water pumps for circulating cooling water through internal combustion engines, such as internal combustion engines for use in motor vehicles. The impeller can also be utilized in pumps for other purposes and for liquids other than water.

Water pumps designed to provide cooling water to internal combustion engines conventionally have a casing containing a pumping chamber, a driven impeller to pump water by centrifugal force, an inlet aligned axially with the impeller and an outlet whose initial channel is tangent to the impeller vanes. The vanes of the impellers have uniformly been of a constant thickness, arcuate in shape and tangent to a circle drawn about the axis of the impeller. The vanes slope backwardly from their inner end to their outer end and force the water to the outlet.

U.S. Pat. No. 6,398,498 B1 discloses an impeller for water pumps. The present invention provides an impeller for liquid pumps that is an improvement on the impeller disclosed in U.S. Pat. No. 6,398,498 B1.

U.S. Pat. No. 6,398,498 B1 discloses feathered vanes arranged on a base rotatable in a housing. For instance, see FIG. 3 of U.S. Pat. No. 6,398,498 B1. The housing disclosed therein has an axial inlet and a radial outlet. The impeller rotates to pump fluid from the inlet to the radial outlet. This is customary for centrifugal liquid pumps that had either prior art constant thickness vanes as disclosed in FIG. 1 of U.S. Pat. No. 6,398,498 B1 or the improved feathered vanes disclosed in FIG. 2 of U.S. Pat. No. 6,398,498 B1.

With the foregoing in mind, an object of the present invention is to provide a novel impeller for water pumps which is effective in pumping water or other liquids. A further object of the present invention is to provide a novel impeller for a centrifugal pump, such as a water pump for a motor vehicle which, for the same or less power requirement as a conventional similar size pump will pump a greater quantity of water, permitting the engine to run cooler and therefore generate more useful power. A still further object of the present invention is to provide an impeller that functions even better than the impellers disclosed in U.S. Pat. No. 6,398,498 B1.

DETAILED DESCRIPTION

Figure 1:
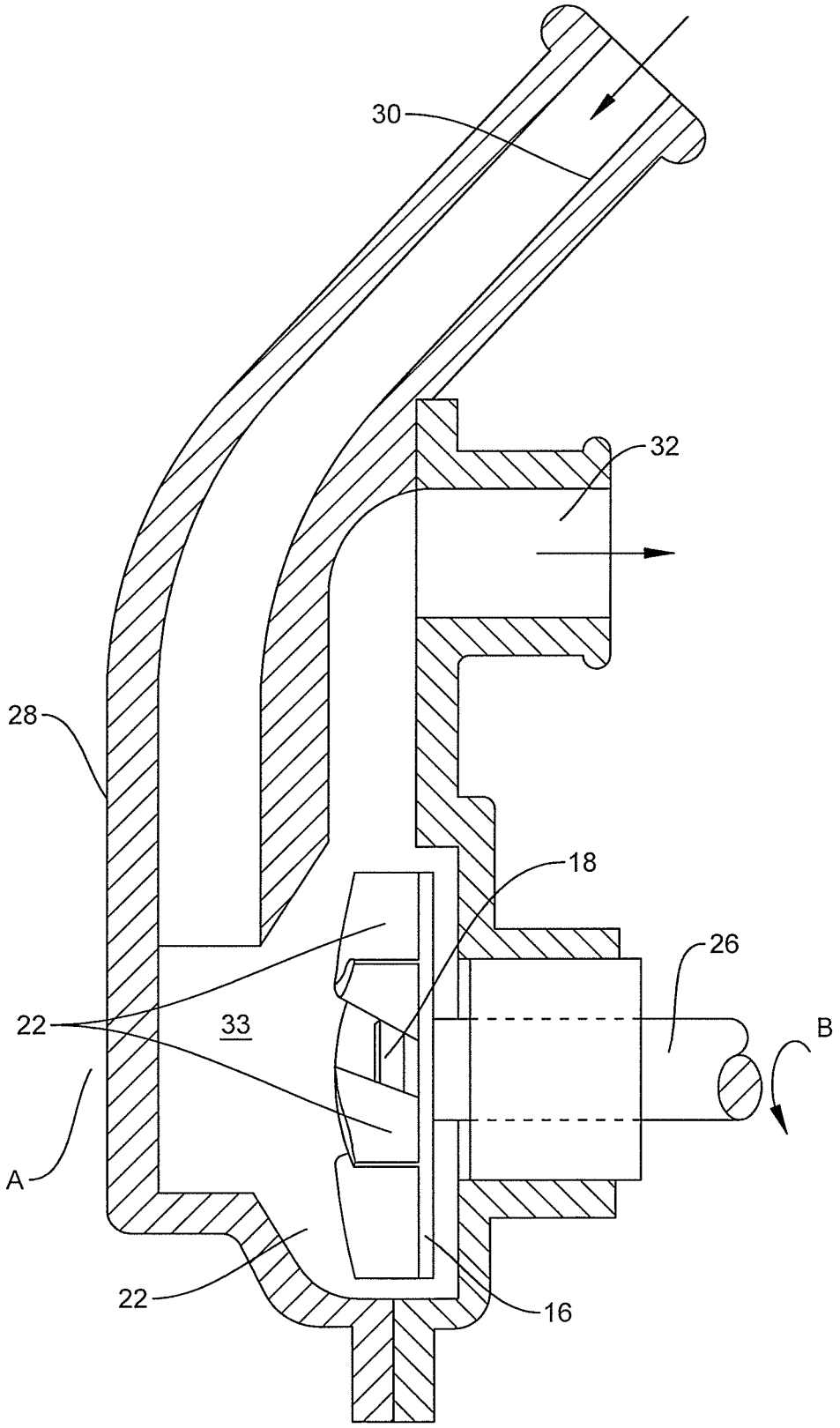
FIG. 1 is a schematic cross-sectional view of a pump housing containing an impeller according to an embodiment.

FIG. 1 illustrates a liquid pump having the same overall configuration as that disclosed in U.S. Pat. No. 6,398,498 B1, but incorporating the impeller of the present invention. The pump includes a pump housing 28 which has a water inlet passage 30 leading to the center of an impeller 14 and an outlet passage 32 extending from the periphery of the impeller 14. The impeller 14 is positioned and contained within a pumping chamber 33 located between the inlet and outlet passages, 30 and 32. The impeller 14 has a mounting boss 18 which is mounted on a shaft 26 for rotating the impeller 14 about a rotational axis A in a direction as shown by arrow "B" in FIG. 1.

Figure 2:
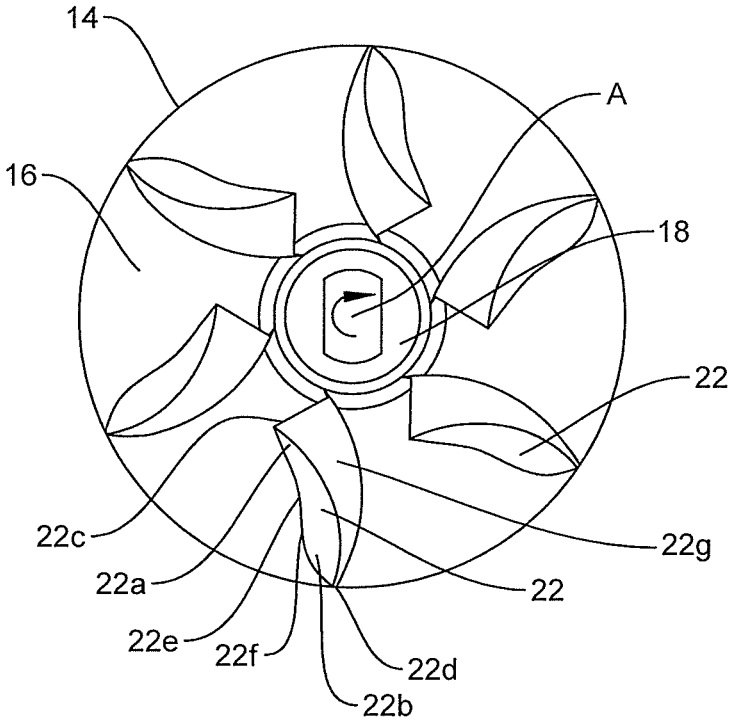
FIG. 2 is a plan view of the impeller.
Figure 3:
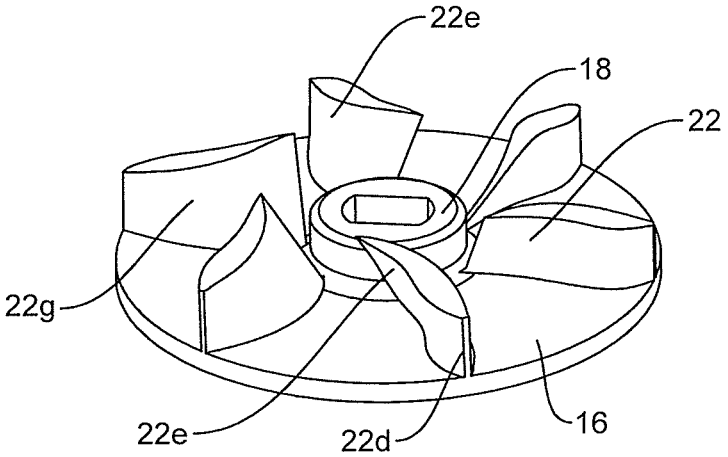
FIG. 3 is a perspective view of the impeller.

As best shown in FIGS. 2 and 3, the impeller 14 has a series of vanes 22 (a total of six vanes 22 as illustrated) provided on a disc-shaped base 16. The vanes 22 and base 16 are configured to fit in the pumping chamber 33 with slight clearances relative to juxtaposed pumping chamber surfaces as customary in centrifugal pumps. Thus, when the shaft 26 is rotated, the vanes 22 cooperate with fluid in the pumping chamber 33 to force the flow of fluid from the inlet passage 30 to the outlet passage 32.

In the impeller disclosed in U.S. Pat. No. 6,398,498 B1, the major extent of the vane's cambered length is disposed relatively more tangent the rotational axis of the base than radially thereof. The improvements made in the present invention reside in providing vanes with a novel configuration and location on the impeller that significantly enhances pumping efficiency.

As illustrated in FIG. 2, the impeller 16 has six (6) vanes 22. Each vane 22 is identical to the other. Each vane 22 has a leading end portion 22*a* and a trailing end portion 22*b* disposed in circumferentially separate locations on the flat disc base 18. The leading end portion 22*a* of each vane 22 is located in closely spaced relation with the centrally located mounting boss 18 that connects the impeller 14 to the mounting shaft 26. With respect to the operative rotational direction of the impeller 14, the leading end portion 22*a* is radially closer to the rotational axis of the impeller than the trailing end portion 22*b*.

Each vane 22 has a leading end edge 22*c* and a trailing end edge 22*d*. The leading end edge 22*c* inclines forwardly at an angle relative to the impeller base 16 and is disposed closely adjacent the cylindrical outer surface of the mounting boss 18. The trailing end edge 22*d* is disposed adjacent the outer periphery of the impeller base 16, and it is disposed parallel with the rotational axis A of the impeller base 16. The leading end edge 22*c* declines slightly backward from where it connects to the impeller base 16 adjacent the mounting boss 18.

Each vane 22 is formed with a camber (i.e., is curved) and has a medial part of the camber extending between its leading edge 22*c* and its trailing edge 22*d*. On opposite sides of the camber are surfaces denominated in relation to the pumping rotational direction of the impeller, e.g. proceeding and receding. The leading, or proceeding surface 22*e* is concave for about one-half the distance from the leading edge 22*c* to the trailing edge 22*d*, and then becomes convex at 22*f* from that location to the trailing edge 22*d*. The trailing, or receding, surface 22*g* is continually convex in its entirety from the leading edge 22*c* to the trailing edge 22*d*. The thickness of each vane 22 is at its maximum at about one-half the length of the median between the vane surfaces.

The leading edge 22*c* of each vane 22 is inclined at about a thirty (30°) angle from the base 16. For instance, see FIG. 4. The trailing edge 22*d* is disposed orthogonal (90°) relative to the flat base 16, i.e., extends parallel to the rotational axis A of the impeller 14. The included angular disposition of the leading and trailing edges, 22*c* and 22*d*, is about thirty degrees (30°).

Figure 4:
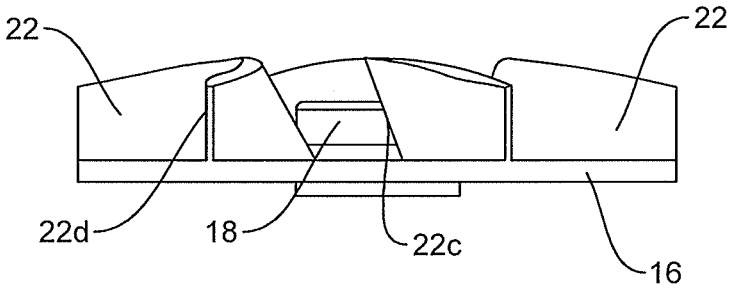
FIG. 4 is an elevational view of the impeller.

A prototype impeller, having a configuration as shown herein in FIGS. 2-4, was made from cast aluminum and tested in a stock housing used in a popular brand vehicle engine. The test was similar to the test disclosed in U.S. Pat. No. 6,398,498 B1.

Figure 5:
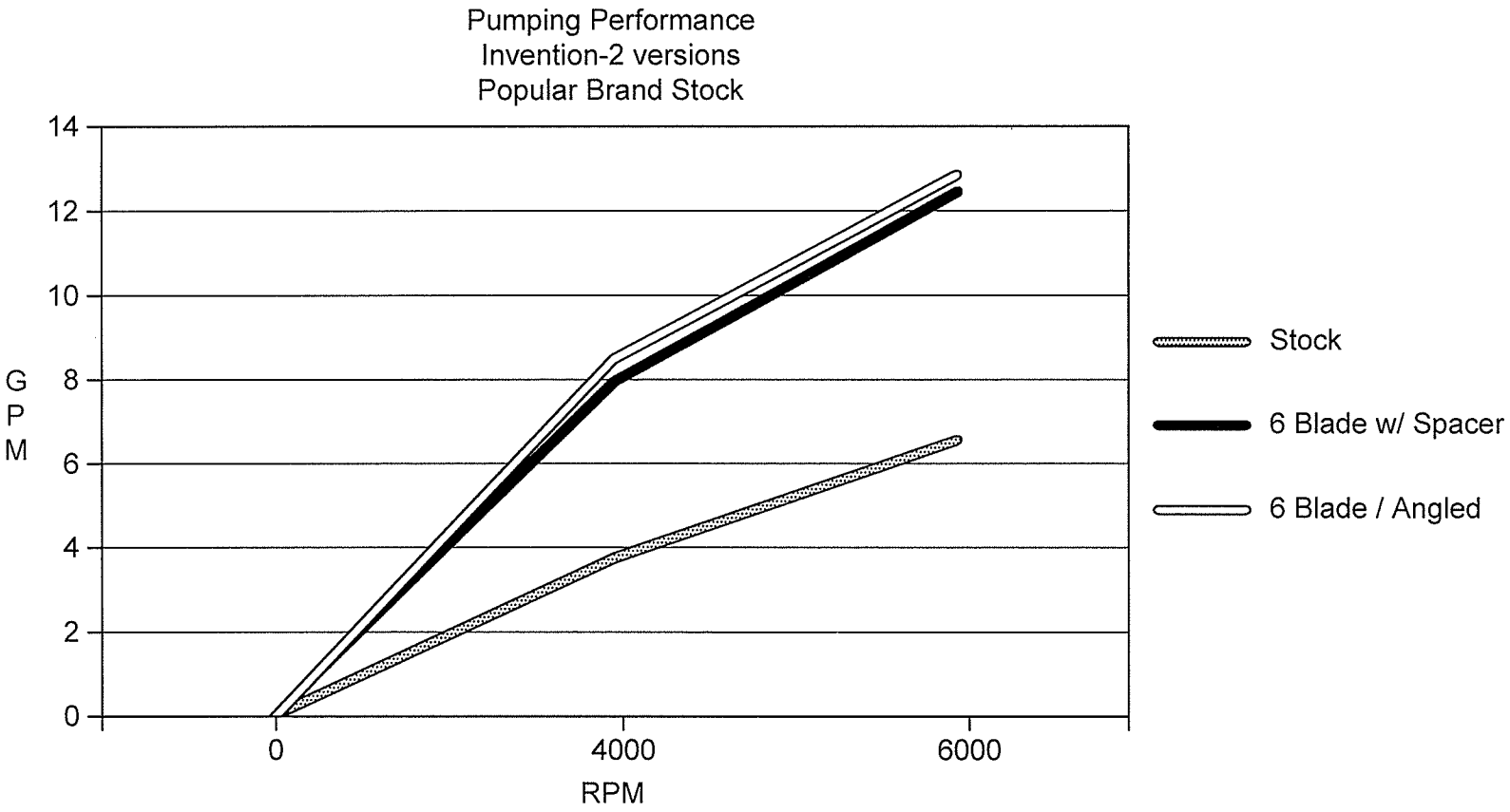
FIG. 5 is a chart showing the performance of the impeller as compared with a prior art impeller.

FIG. 5 is a graph showing the quantity of flow of cooling water through three water pumps for an internal combustion engine, each water pump being identical in size, at varying speeds. The pumps were driven by an electric motor controlled by a rheostat.

As shown in FIG. 5, two (2) slightly different versions of an impeller built in accordance with the present invention (i.e., having the configuration as shown herein of FIGS. 2-4) showed significant differences in pumping capabilities over a full range of rotational speeds up to 6000 rpm relative to a stock impeller. (The lower line in FIG. 5 corresponds to the stock impeller and the two upper lines correspond to the present invention.) At the maximum speed tested, the improved impeller pumped twice as much cooling fluid as the stock pump impeller.

While a particular embodiment of the present invention has been illustrated and described herein, it is not intended to limit the invention to such a disclosure and changes and modifications may be incorporated and embodied there within the scope of the accompanying claims.

I claim:

1. An impeller for a liquid pump, comprising:

a base with a connector boss located at a center of rotation of the impeller; and a plurality of vanes extending from the base in spaced relation about the connector boss, each vane having a leading end edge adjacent the connector boss and a trailing end edge adjacent an outer periphery of the base;

each of said trailing end edges being disposed parallel to an axis of rotation of the base, and each of said leading end edges being inclined forwardly at an angle relative to an operative rotational direction of the impeller and being spaced from the connector boss;

wherein, for each of the plurality of vanes, the leading end edge thereof is disposed at an acute angle of 30° relative to the trailing end edge thereof.

2. The impeller according to claim 1, wherein each vane has a predetermined camber length between the leading end edge and the trailing end edge, each vane has a proceeding surface and a receding surface along the predetermined camber length, and each vane has a thickness between the proceeding surface and receding surface that varies along the predetermined camber length.

3. The impeller according to claim 2, wherein each vane is disposed forward relative to the operative rotational direction of the impeller of a radial line extending from an axis of rotation of the impeller to the trailing end edge of each vane.

4. The impeller according to claim 2, wherein the proceeding surface of each vane is concave adjacent the leading end edge and convex adjacent the trailing end edge.

5. The impeller according to claim 4, wherein the receding surface of each vane is continually convex between said leading end edge and trailing end edge.

6. A centrifugal pump, comprising a housing having an inlet passage leading to a center of an impeller and an outlet passage extending from a periphery of the impeller, the impeller being positioned and contained within a pumping chamber located between the inlet and outlet passages for rotation within the pumping chamber about an axis of rotation, the impeller having a base with a connector boss located at a center of rotation of the impeller and a plurality of vanes extending from the base in spaced relation about the connector boss, each vane having a leading end edge adjacent the connector boss and a trailing end edge adjacent an outer periphery of the base, and each of said trailing end edges being disposed parallel to an axis of rotation of the base and each of said leading end edges being inclined forwardly at an angle relative to an operative rotational direction of the impeller and being spaced from the connector boss, wherein, for each of the plurality of vanes, the leading end edge thereof is disposed at an acute angle of 30° relative to the trailing end edge thereof.

7. The centrifugal pump according to claim 6, wherein each vane has a predetermined camber length between the leading end edge and the trailing end edge thereof, each vane has a proceeding surface and a receding surface along the predetermined camber length, and each vane has a thickness between the proceeding surface and receding surface that varies along the predetermined camber length.

8. The centrifugal pump according to claim 7, wherein each vane is disposed forward relative to the operative rotational direction of the impeller of a radial line extending from the axis of rotation of the impeller to the trailing end edge thereof.

9. The centrifugal pump according to claim 7, wherein the proceeding surface of each vane is concave adjacent the leading end edge and convex adjacent the trailing end edge.

10. The centrifugal pump according to claim 9, wherein the receding surface of each vane is continually convex between said leading end edge and trailing end edge.

* * * * *